US005265366A

United States Patent [19]

Thompson

[11] Patent Number: 5,265,366

[45] Date of Patent: Nov. 30, 1993

[54] FOAM RECOIL PAD FOR FIREARMS

[76] Inventor: Gary G. Thompson, P.O. Box 721, Whitefish, Mont. 59937

[21] Appl. No.: 913,222

[22] Filed: Jul. 14, 1992

[51] Int. Cl.[5] ..... F41C 23/00

[52] U.S. Cl. ..... 42/74

[58] Field of Search ..... 42/74, 71.01; 135/73, 135/71

[56] References Cited

U.S. PATENT DOCUMENTS

| | | | |
|---|---|---|---|
| 202,606 | 4/1878 | Thornton et al. | 42/74 |
| 779,461 | 6/1905 | Benton | 42/74 |
| 1,774,060 | 2/1929 | Hodge | 42/74 |
| 1,842,527 | 1/1932 | Knight | 42/74 |
| 2,353,885 | 7/1944 | Fanger et al. | 42/74 |
| 2,438,142 | 3/1948 | Brower | 42/74 |
| 2,468,349 | 9/1945 | Stewart | 42/74 |
| 2,677,207 | 5/1954 | Stewart | 42/74 |
| 3,484,977 | 12/1969 | Younts | 42/74 |
| 3,514,889 | 7/1968 | Pachmayr | 42/74 |
| 3,696,544 | 4/1972 | Webb | 42/74 |
| 4,127,953 | 11/1977 | McBride | 42/71 WR |

*Primary Examiner*—David H. Brown

[57] ABSTRACT

A recoil pad for attachment to a firearm buttstock of the type having a retaining sleeve (14) and an end wall (16) which communicate to form a unitary boot. The sleeve (14) and wall (16) are constructed of similar density foam material, so as to absorb recoil upon the discharge of the firearm. The predetermined exterior dimension of the unitary boot is substantially larger than the dimension of rifle buttstock (12). This increased area allows the pad to disperse recoil impact more effectively. In addition, the retaining sleeve (14) may contain two, or more, sets of corresponding integrated incisions (22,24,26) which define earplug excisions (20).

1 Claim, 2 Drawing Sheets

FOAM RECOIL PAD FOR FIREARMS

BACKGROUND—FIELD OF INVENTION

This invention relates to a unique and effective shock-absorbing device for firearms, particularly to shock-absorbing recoil boots which when placed over the buttstock of firearms protects the user from excessive recoil impact upon discharge of the firearm.

BACKGROUND—DESCRIPTION OF PRIOR ART

It is widely recognized by firearm users that when a weapon is discharged, it produces a considerable amount of energy which is transmitted back to the user in the form of recoil. This is particularly evident in the magnum caliber rifles used by sportsmen.

Conventional approaches in the effort to reduce the discomfort experienced from recoil have revolved mainly around pads, or other devices, which are permanently attached to the rifle buttstock. These devices are limited to the dimension of the buttstock for practical and aesthetic reasons. Many require considerable modification to install, particularly those devices which are mechanical in nature. Even the simplest recoil pad often requires custom fitting to the buttstock, resulting in considerable cost of time or expense.

Although many existing recoil pads achieve their primary goal with some effectiveness, their scope is confined by design and construction limitations. Some slip-on, or boot type pads exist, which utilize tight-fitting rubber sleeves for attachment to the buttstock. The end of the boot defines a rear compartment which is occupied by air, or various other materials. An example of air in the rear compartment is shown in U.S. Pat. No. 1,774,060 to Hodge. An example of the compartment being filled with fluid impregnated material is shown in U.S. Pat. No. 3,696,544 to Webb. Pads with tight-fitting rubber sleeves do not lend themselves to easy application or removal. U.S. Pat. No. 2,468,349 to Stewart discloses a recoil pad with a rubber sleeve descriptive of this limitation.

Furthermore, all recoil devices for attachment to firearms heretofore known suffer from these disadvantages:

(a) Existing pads limit themselves to the approximate dimension of the buttstock of the firearm. This limitation results in the recoil force from the discharge of the firearm being transmitted to the user in a narrowly defined area of the shoulder.

(b) Existing recoil pads, both permanent and boot type, have been designed with the consideration they will basically be left attached to the firearm. Consequently, their outer surfaces have been made of tough, abrasion-resistant material. This compromise has limited the amount, and thickness, of soft shock-absorbing material that has been used in the pads.

(c) The use of thin rubber sleeves, or other firm material, does not lend itself to the use of removable small segments of the pad for earplugs. Protection of the shooter from the loud sound of firearm discharge is as important as recoil protection.

(d) Being basically designed to be permanently attached to the firearm, existing pads do not offer the option of color selections for differing shooting conditions.

Traditional theory has been that a soft, oversized temporary recoil pad could not be used effectively because it would alter the fit of the gunstock, be cumbersome, and lack durability when used in the field. However, conventional approaches to recoil reduction fail to recognize an important phenomenon. When a sportsman fires a shot in a hunting situation, they seldom, if ever, sense recoil impact. This obliviousness is primarily due to the distraction and exhiliration of the moment. Recoil is most intensely experienced by the sportsman while shooting in the controlled and focused conditions of the rifle range. This is where the rifle owner fires the vast majority of his shots each year. U.S. Pat. No. 4,127,953 to McBride shows recognition of the objective of a recoil boot to be used primarily at the rifle range, but this device is extremely heavy, elaborate, and inconvenient.

OBJECTS AND ADVANTAGES

My general objective is to provide a recoil pad of larger dimension than the firearm buttstock to which it is applied, and constructed of highly shock-absorbent foam material.

Other objects and advantages of my invention are:

(a) to provide a recoil pad which can be applied and removed easily and conveniently from the firearm buttstock;

(b) to provide a recoil pad which has a larger area of contact with the user's shoulder, thereby dispersing the recoil shock over a larger area of the body;

(c) to provide a recoil pad constructed of material the characteristics of which are compatible to having integral, removable excisions, such as earplugs, available to the user;

(d) to provide a recoil pad which incorporates earplugs to the user as a comfort and safety consideration;

(e) to provide an effective recoil pad which can be applied to the firearm buttstock with no modification to the weapon;

(f) to provide an effective recoil pad to the user at a very economical level;

(g) to provide recoil pads in various colors for different applications. A bright colored pad would be preferred for safety, or to avoid being misplaced by the user. A dark, or camouflaged pad would be more desirable if a user should choose to use the pad in a hunting situation.

Other objects and advantages will be apparent from consideration of the ensuing description and drawings.

Figure 1:
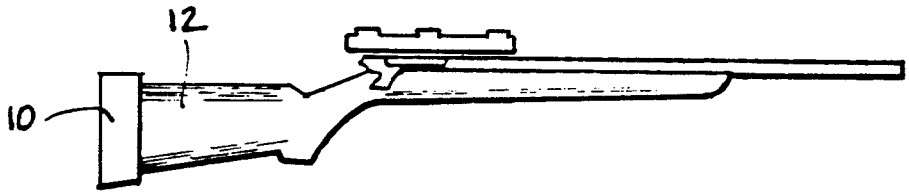
FIG. 1 is a side elevation view of foam recoil pad mounted on a rifle.

| Reference Numerals in Drawings | |
|---|---|
| 10 | recoil pad |
| 12 | rifle buttstock |
| 13 | rifle stock buttplate |
| 14 | foam retaining sleeve |
| 16 | foam base wall |
| 18 | sleeve and wall bond line |
| 20 | earplug excision |
| 22 | vertical incision A |

-continued

| Reference Numerals in Drawings | |
|---|---|
| 24 | vertical incision B |
| 26 | horizontal incision C |

DESCRIPTION OF ILLUSTRATED EMBODIMENTS

Figure 2:
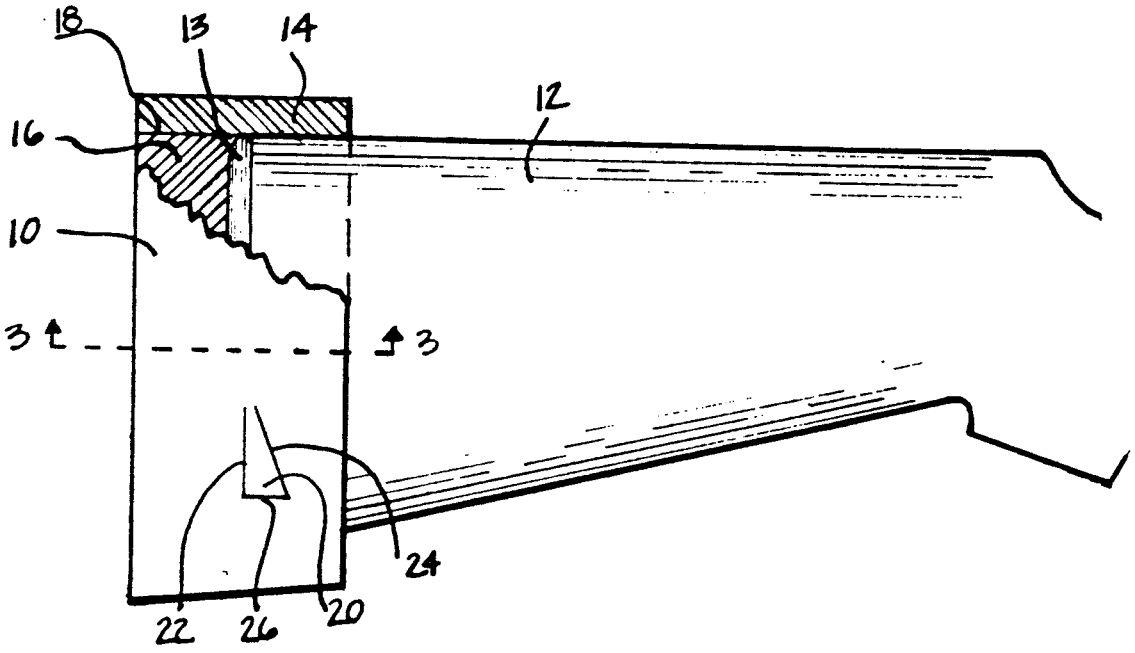
FIG. 2 is a side elevation view of the foam recoil pad as mounted on a rifle stock and partly broken away to show details of construction.
Figure 3:
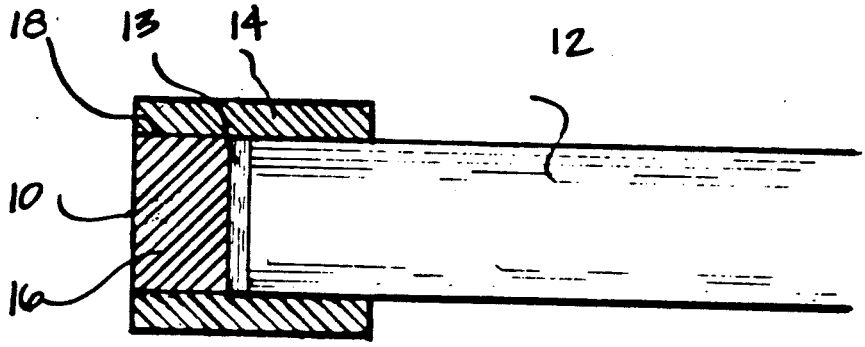
FIG. 3 is a sectional view along line 3—3 of drawing No.2

Reference is now made to drawing FIGS. 1 and 2, which show my foam recoil pad, designated by reference no. 10, as seen mounted on the end of rifle buttstock 12. The pad is open at one end so as to receive buttstock 12. Drawing FIGS. 2 and 3 show Pad 10 comprised of foam retaining sleeve 14 foam and base wall 16 which form a unitary boot. The end of base wall 16 is shaped approximately the same template dimension as rifle stock buttplate 13, which is an ellipse of dimensions roughly 44 mm×130 mm. The side thickness of base wall 16 is approximately 26 mm to 32 mm. Sleeve 14 would initially be a rectangular sheet of flat material. The dimensions of sleeve 14, before attachment to base 16, would be approximately 65 mm×320 mm, with a thickness of 8 mm to 15 mm.

A suitable contact adhesive is then applied to the sides of base wall 16, and to the appropriate corresponding contact areas of sleeve 14. Starting at a predetermined point, sleeve 14 is then wrapped around the side of base wall 16 until it adjoins its opposite end to form continuous retaining sleeve 14. Base wall 16 and sleeve 14 are permanently bonded along a contact area designated by sleeve and wall bond line no. 18. The circumference of sleeve 14 runs from smaller at its open end, to slightly larger at its intersection with base wall 16. Pad 10 might also be constructed by a molding process, whereby sleeve 14 and wall 16 become an integral construction and bond line 18 would not be present. Base wall 16 is constructed of highly shock-absorbent foam material. Retaining sleeve 14 may be constructed of the same, or higher density foam material. In the preferred embodiment of pad 10, it is constructed entirely of a foam material such as ethylene vinyl acetate. However, pad 10 can consist of any other singular or combination of foam materials which have high shock-absorption capability. Such materials might include neoprene, ethylene propylene terpolymer, nitrile, styrene butadine, polyvinyl chloride, silicone, polyethylene, polyolefin, or any other suitable open or closed-cell foam material.

Figure 4:
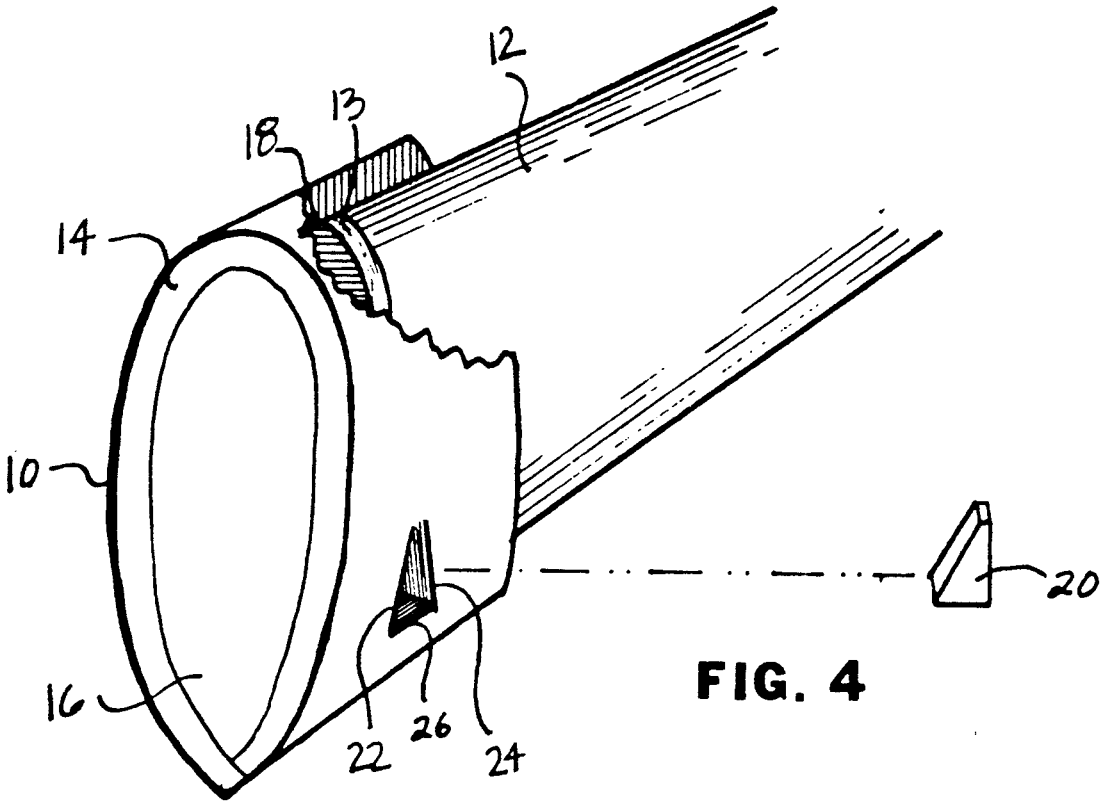
FIG. 4 is an end isometric view with hidden lines and partly broken away to show details of construction.

Referring to drawing FIG. No. 2, there is shown a small plug or earplug excision 20, positioned on the side of retaining sleeve 14. Excision 20 is formed by vertical incision 22, vertical incision 24, which are adjoined at their most distant corresponding ends by horizontal incision 26. Drawing FIG. 4 shows excision 20 removed from sleeve 14. Incision 22, incision 24, and incision 26 define a void in sleeve 14 created by the removal of excision 20. In this embodiment of pad 10, sleeve 14 would be of a higher density foam than base wall 16. This would provide excision 20 with the adequate structural integrity required to retain it's shape while being inserted in the user's ear. Sleeve 14 is to have a minimum, but not limited to, one pair of excision 20*s* positioned in various predetermined locations. Incisions 22, 24, and 26 would be created by die-cutting in this particular embodiment of pad 10. If a molding process were employed to fabricate pad 10, appropriate consideration could be integrated in the mold to create removable excisions for use as earplugs.

From the description above, a number of advantages of my foam recoil pad become evident:

(a) The ample use of shock-absorbent foam material for both the end wall, and the retaining sleeve, of the recoil pad provide for superior recoil reduction capability.

(b) The unusually large area created on the base of the recoil pad provides for a wider area of contact with the user's shoulder, thereby dispersing the shock impact more effectively.

(c) The availability of suitable foam materials in a wide array of colors allows the manufacturer to offer the recoil pad in color options with relative ease.

(d) With the unique utilization of foam material for the entire construction of the recoil pad, the feature of offering internal earplugs becomes available.

EXPLANATION OF OPERATION

To use the recoil pad 10, the open end of the sleeve 14 is slipped onto rifle buttstock 12, and then pushed forward until it is in firm contact with rifle stock buttplate 13. Sleeve 14 is of slightly smaller circumference at its open end than where it communicates with base 16. This allows the pad to be applied easily, yet remain slightly snug while in use. The outer end of pad 10 is of thick, wide, shock-absorbent foam material. When firearm 12 is placed in shooting position, the pad conforms to a large area of the user's shoulder. This embodiment of the invention is illustrated in FIGS. 3 and 4. FIG. 3 is a horizontal sectional view through the central area of attachment. The increased area of the butt of pad 10, created by sleeve 14 and end wall 16, provide a much larger area of contact with the user's shoulder. This increased width will disperse the recoil impact from discharge of the rifle over a larger area of the user's body, thereby reducing its effect.

Another exemplary embodiment of the invention is illustrated in FIG. 4, an isometric view of pad 10. Excision 20 may be removed from sleeve 14 by grasping the excision along vertical incision 22 and vertical incision 24 and tearing it away from its narrow attachment at its base. Excision 20, being comprised of the same foam material as sleeve 14, becomes a small foam wedge compatible for use as a earplug. Each pad would contain at least two duplications of excision 20, so as to provide earplugs for both the user's ears.

SUMMARY, RAMIFICATIONS, AND CONCLUSION

The reader will see that the large amount of shock-absorbent material comprising the base of the invention will provide superior recoil reductions experienced by the user. In addition, the increased dimension of the pad, where it is in contact with the user's shoulder, will disperse the shock effect of the discharge of the rifle over a larger area. The combination of these features will greatly reduce the discomfort, or possible contusion, inflicted on the firearm user. Furthermore, the pad has the additional advantages of being constructed of a material which is compatible with the integration of removable excisions, to be used as earplugs, as a comfort and safety consideration;

being very easy to attach and remove from a firearm, thereby making its use very convenient;

providing a high degree of recoil reduction at a very reduced expense to the shooter;

ease of application to firearms whereby it might conveniently be shared by a number of shooters in a rifle range shooting situation;

being easily provided in a number of color options, whereby the user may choose a color to fit their particular priorities.

Although the description above contains many specificities, these should not be construed to limiting the scope of the invention, but merely providing illustration of a presently preferred embodiment of the invention. For example, the pad may be constructed in other manners, such as compression molding; the earplug excisions could be integrated into another area of the pad, or have different shapes.

Thus the scope of the invention should be determined by the appended claims and their legal equivalents, rather than the examples given.

I claim:

1. A recoil pad for a firearm buttstock comprising a unitary boot of foam material having a dimension in excess of that of a firearm buttstock, said unitary boot containing a predetermined number of integral incisions, said incisions to be of predetermined length and proximity, whereby creating removable excisions.

* * * * *